US006313761B1

(12) United States Patent
Shinada

(10) Patent No.: US 6,313,761 B1
(45) **Date of Patent: *Nov. 6, 2001**

(54) INFORMATION RECEIVING APPARATUS, POSITIONING APPARATUS, NAVIGATION APPARATUS, INFORMATION RECEIVING METHOD, POSITIONING METHOD AND NAVIGATING METHOD

(75) Inventor: Akira Shinada, Kanagawa (JP)

(73) Assignee: Sony Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/759,812

(22) Filed: Dec. 3, 1996

(30) Foreign Application Priority Data

Dec. 25, 1995 (JP) ..... 7-351045

(51) Int. Cl.[7] ..... G08G 1/123
(52) U.S. Cl. ..... 340/995; 340/905; 701/208
(58) Field of Search ..... 340/995, 990, 340/905; 701/208, 209, 211

(56) References Cited

U.S. PATENT DOCUMENTS 4,812,843 * 3/1989 Champion, III et al. ..... 340/993
5,146,219 * 9/1992 Zechnall ..... 340/995
5,257,023 * 10/1993 Furuya ..... 340/905
5,293,163 * 3/1994 Kakihara et al. ..... 340/905
5,406,490 * 4/1995 Braegas ..... 340/905
5,523,950 * 6/1996 Peterson ..... 340/905
5,546,311 * 8/1996 Sekine ..... 340/995
5,614,898 * 3/1997 Kamiya et al. ..... 340/995
5,635,924 * 6/1997 Tran et al. ..... 340/905
5,649,300 * 7/1997 Snyder et al. ..... 340/905
5,864,305 * 1/1999 Rosenquist ..... 340/905

* cited by examiner

*Primary Examiner*—Brent A. Swarthout
(74) *Attorney, Agent, or Firm*—Jay H. Maioli

(57) ABSTRACT

The invention provides a navigation apparatus wherein necessary traffic information can be acquired without any key operation during running of an automobile. The navigation apparatus includes a positioning device for getting a present position, a map data retrieving device for retrieving map data from a map database, a map display unit for displaying a map, an input device for entering a desired condition to receive information, a memory for storing the entered condition, an access device for accessing to an external information source, and a decision device for deciding a status. The decision device receives information from the external information source through the access device, and the map display unit displays the received information in accordance with map data retrieved by the map data retrieving device if the status matches the condition stored in the memory.

8 Claims, 3 Drawing Sheets

INFORMATION RECEIVING APPARATUS, POSITIONING APPARATUS, NAVIGATION APPARATUS, INFORMATION RECEIVING METHOD, POSITIONING METHOD AND NAVIGATING METHOD

BACKGROUND OF THE INVENTION

1. Field of the Invention

This invention relates to an information receiving apparatus, a positioning apparatus, a navigation apparatus, an information receiving method, a positioning method and a navigating Method.

2. Description of the Related Art

An organization which provides traffic information, for example, the ATIS (Advanced Traffic Information Service) is available in Japan. A user can telephone the ATIS to get digital data of traffic congestion information, traffic control information and other information.

Some available navigation apparatus for an automobile are compatible with the ATIS. In a navigation apparatus of the type compatible with the ATIS, if, for example, key operations (1) to establish an ATIS mode, (2) to establish a communication mode, (3) to set, in route guidance, a present position, a destination and so forth, and (4) to telephone the ATIS are performed, then, for example, an optimum route considering current traffic congestion situation can be found from among several routes from the present position of the automobile to the desired destination and displayed on a display unit.

However, such key operations of those operations (1) to (4) described above are cumbersome. Therefore, taking also safety into consideration, most navigation apparatus are so constructed that those operations are disabled while the automobile is running. Even if a navigation apparatus is not constructed as such, it still is undesirable to perform key operations during running of an automobile from the point of view of safety.

SUMMARY OF THE INVENTION

It is an object of the present invention to provide a navigation apparatus and a navigating method wherein necessary traffic information can be acquired without any key operation during running of an automobile.

It is another object of the present invention to provide an information receiving apparatus, a positioning apparatus, an information receiving method and a positioning method suitable for use with such navigation apparatus and navigation method as mentioned above.

In order to attain the objects described above, according to an aspect of the present invention, there is provided a navigation apparatus with a data receiving operation function, including positioning means for getting a present position, map data retrieving means for retrieving map data from a map database, map display means for displaying a map, input means for entering a desired condition to receive information, memory means for storing the condition, access means for accessing to an external information source, and decision means for deciding a status, wherein the decision means receives information from the external information source through the access means and the map display means displays the received information in accordance with map data retrieved by the map data retrieving means if the status matches the condition stored in the memory means.

In the navigation apparatus, a navigating method with an automatic operation feature is performed which includes the inputting step of entering a desired condition to receive information, the storing step of storing the entered condition, the positioning step of getting a present position, the map data retrieving step of retrieving map data from a map database, and the deciding step of deciding a status, wherein the deciding step receives information from the external information source through radio communication means and displays the received information in accordance with map data retrieved in the map data retrieving step if the status matches the condition stored in the storing step.

With the navigation apparatus and the navigating method, for example, when the automobile starts, the necessary traffic information is available already, and a navigation display can be obtained in a latest traffic situation. Further, traffic information can be obtained automatically midway of a route to a destination, and a navigation display can still be performed in a latest traffic situation. Further, since cumbersome key operations need not be performed during running of the automobile, safety is assured. Further, there is no need of having a fellow passenger manually operate the navigation apparatus.

According to the present invention, an information receiving apparatus, a positioning apparatus, an information receiving method and a positioning method suitable for use with the navigation apparatus and navigation method are provided.

In particular, according to another aspect of the present invention, there is provided an information receiving apparatus with an automatic operation function, which includes input means for entering a desired condition to receive information, memory means for storing the entered condition, access means for accessing to an external information source, and decision means for deciding a status, wherein the decision means receives information from the external information source through the access means if the status matches the condition stored in the memory means.

In the information receiving apparatus, an information receiving method with an automatic operation feature is performed which includes the inputting step of entering a desired condition to receive information, the storing step of storing the entered condition, and the deciding step of deciding a status, wherein the deciding step receives information from the external information source through radio communication means and displays the received information if the status matches the condition stored in the storing step.

According to a further aspect of the present invention, there is provided a positioning apparatus with a data receiving operation function, which includes positioning means for getting a present position, input means for entering a desired condition to receive information, memory means for storing the entered condition, access means for accessing to an external information source, and decision means for deciding a status, wherein the decision means receives information from the external information source through the access means if the status matches the condition stored in the memory means.

In the positioning apparatus, a positioning method with an automatic operation feature is performed which includes the inputting step of entering a desired condition to receive information, the storing step of storing the entered condition, the positioning step of getting a present position, and the deciding step of deciding a status, wherein the deciding step receives information from the external information source through radio communication means and displays the received information if the status matches the condition stored in the storing step.

The above and other objects, features and advantages of the present invention will become apparent from the following description and the appended claims, taken in conjunction with the accompanying drawings.

DESCRIPTION OF THE PREFERRED EMBODIMENT

Figure 1:
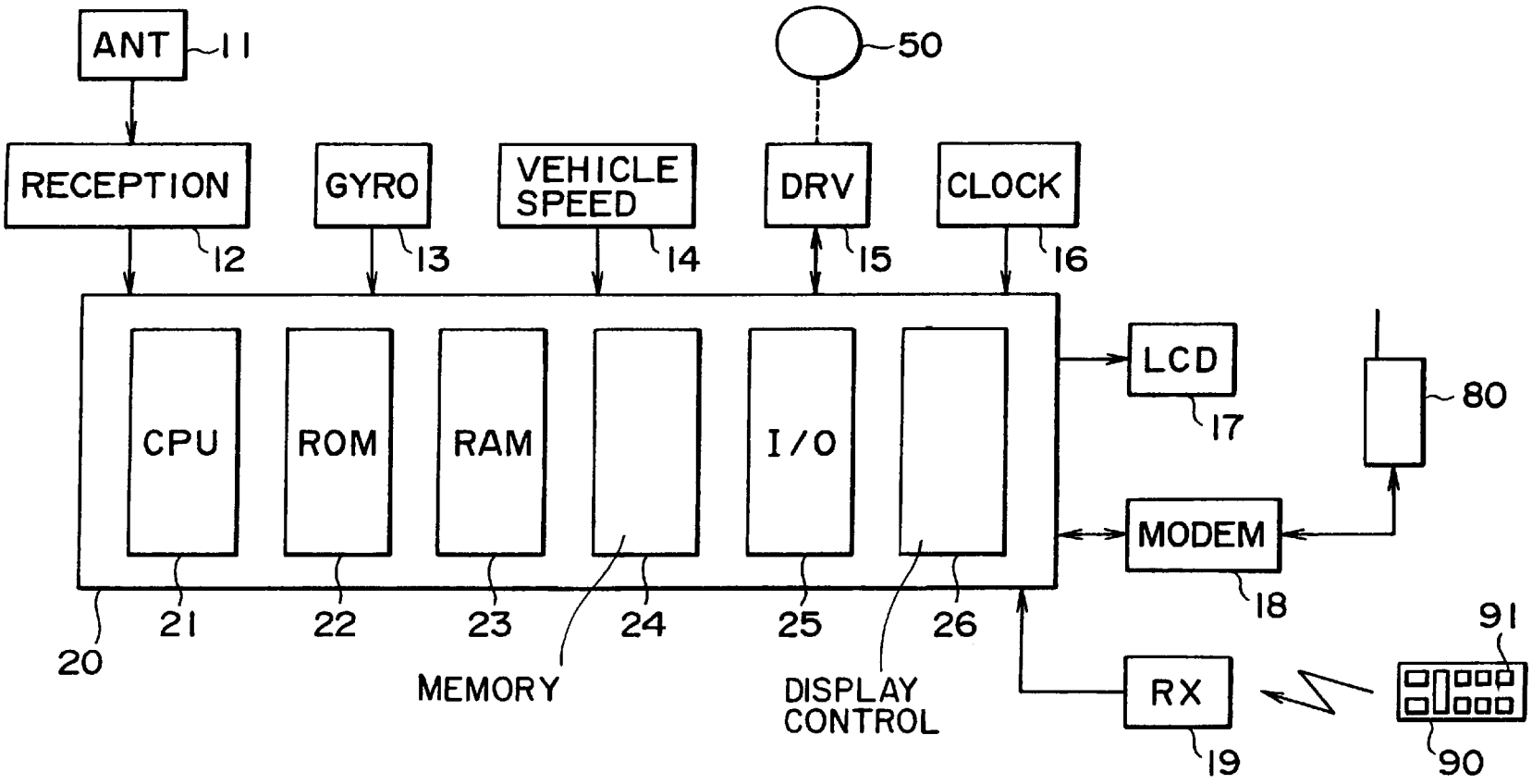
FIG. 1 is a block diagram of a navigation apparatus showing a preferred embodiment of the present invention.

FIG. 1 shows a preferred embodiment of the present invention applied to a vehicle-carried navigation apparatus. Referring to FIG. 1, a radio wave from a navigation satellite, for example, a GPS satellite, is received by a GPS antenna 11 of the navigation apparatus, and the received signal is supplied to a GPS unit (receiving circuit) 12. Data of a position of an automobile on which the navigation apparatus is carried, a moving speed of the automobile and so forth are outputted from the GPS unit 12 and supplied to a microcomputer 20.

The navigation apparatus further includes a self-contained navigation unit such as, for example, a gyroscope 13, from which data of a moving speed of the navigation apparatus are outputted. The data are supplied to the microcomputer 20. The navigation apparatus further includes a vehicle speed sensor 14 for detecting a running speed of the automobile, and an output signal of the vehicle speed sensor 14 is supplied to the microcomputer 20.

The navigation apparatus further includes a drive unit 15 for a CD-ROM (compact disk ROM (read only memory)). A CD-ROM 50 which is read by the drive unit 15 has written in advance therein various data necessary for navigation such as, for example, image data to be used to display a map. The data of the CD-ROM 50 are read out by the drive unit 15 and supplied to the microcomputer 20.

Further connected to the microcomputer 20 are a clock circuit 16 for counting the present time and, for example, a color LCD (liquid crystal display) 17 as a display unit.

Further, a modem 18 as means for accessing to an organization which provides traffic information is connected to the microcomputer 20, and a mobile telephone set, for example, a portable telephone set 80, is connected to the modem 18.

Since the number of operation keys which can be provided on a panel face of a vehicle-carried apparatus is limited, the navigation apparatus of FIG. 1 is constructed such that various operations can be performed by remote control (remote operation).

To this end, a reception circuit 19 for a remote control signal, for example, of infrared rays is connected to the microcomputer 20 such that, if one of operation keys 91 of a transmitter 90 of a remote controller is manually operated, then an infrared ray signal having data corresponding to the operated key is outputted from the transmitter 90. The infrared ray signal is received by the reception circuit 19, and the data of the operated key is supplied to the microcomputer 20.

The microcomputer 20 includes a CPU (central processing unit) 21, a ROM 22 in which a program is written, a RAM (random access memory) 23 for a working area, and a memory 24 for storing data.

Figure 2:
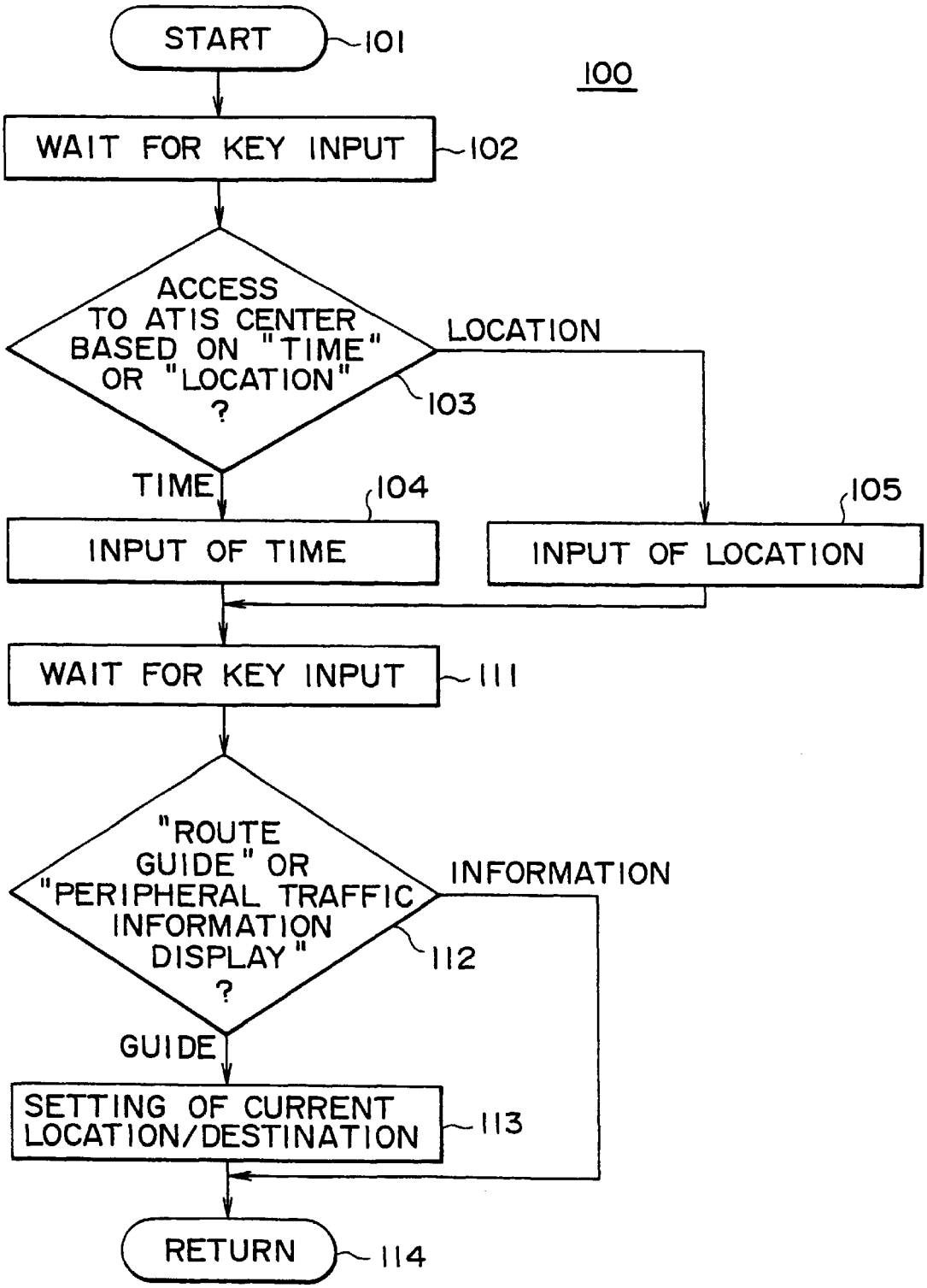
FIGS. 2 and 3 are flow charts illustrating operation of the navigation apparatus of FIG. 1.
Figure 3:
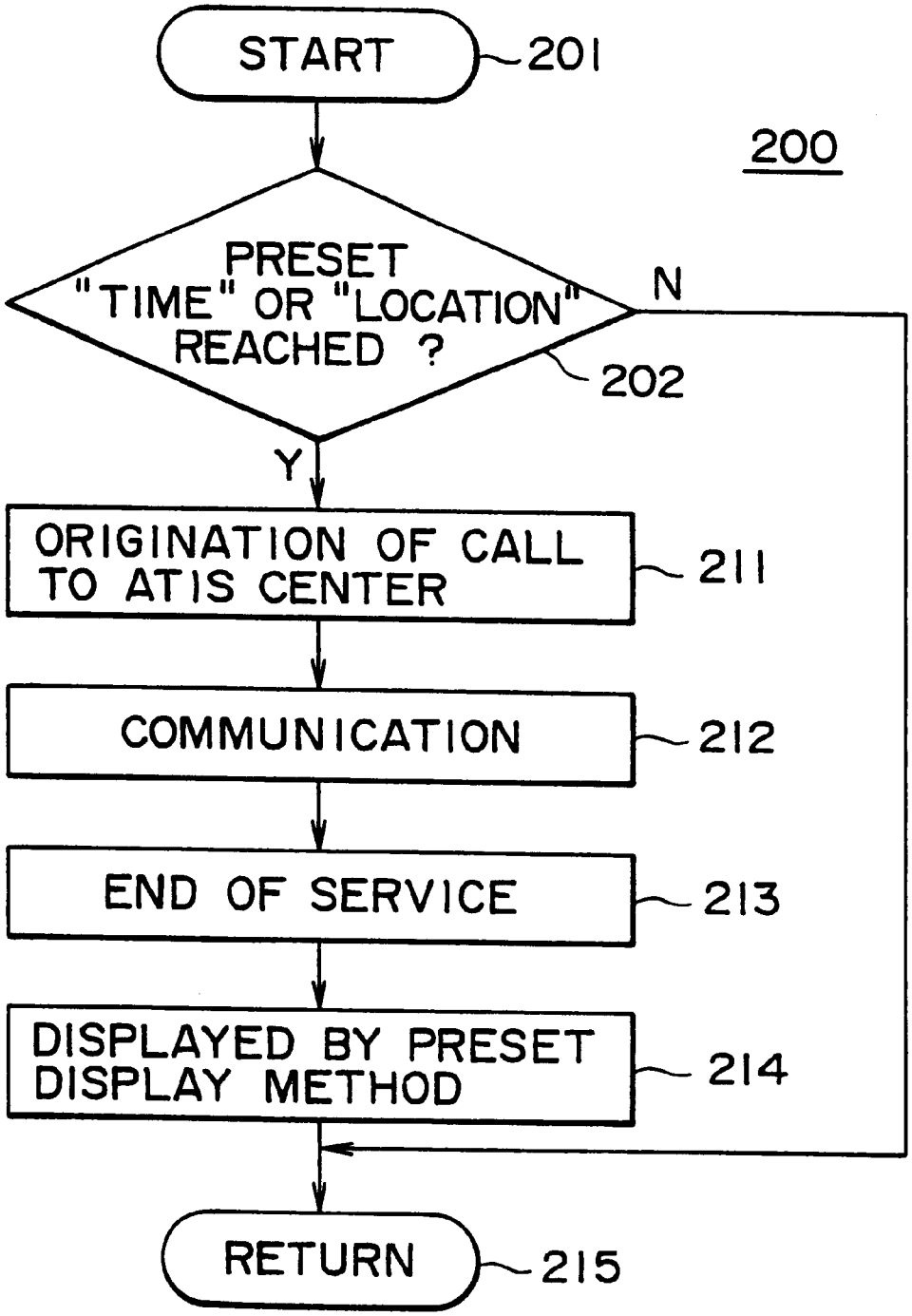

The ROM 22 includes, as part of the program written therein, for example, a setting routine 100 and an access routine 200 illustrated in FIGS. 2 and 3, respectively. Details of the routines 100 and 200 will be hereinafter described.

The microcomputer 20 has a port (interface circuit) 25 for inputting and outputting data therethrough and a display controller 26. Display data from the CPU 21 are converted into a display signal by the display controller 26 and supplied to the color LCD 17 so that an image of a map or the like corresponding to the data supplied to the display controller 26 is displayed on the color LCD 17.

In the navigation apparatus having the construction described above, when the ATIS is to be accessed, a user will manually operate a setting key from among the operation keys 91 of the transmitter 90 before the user starts driving of the automobile.

In response to the manual operation of the setting key, the navigation apparatus puts itself into a setting key mode, in which the process of the CPU 21 of the microcomputer 20 starts from step 101 of the setting routine 100. Then, in step 102, the CPU 21 puts itself into a key input waiting state. The key input waiting state is provided for the user to select a utilization method of the ATIS and allows designation of one of the following choices (1) and (2):

(1) To access the ATIS when a certain point of time set in advance comes.

This may be designated, for example, in such a case that, as the user is planned to drive at xx o'clock tomorrow, the user wants to utilize latest data of the ATIS then.

(2) To access to the ATIS if the automobile passes or arrives at a certain place or location set in advance.

This may be designated, for example, in such a case that the user wants to know, after the automobile reaches xx, an uncrowded road ahead xx together with a route. Thus, the CPU 21 waits for a key inputting operation for selection of one of the two choices.

Then, if a key inputting operation to designate the choice (1) or (2) is performed, then the process advances to step 103, in which the key input in step 102 is discriminated. If it is discriminated that the choice (1) has been selected, then the process advances from step 103 to step 104. Then, in step 104, the CPU 21 puts itself into a waiting state for the point of time of the choice (1), and if the point of time is inputted, then the process advances to step 111.

On the other hand, when it is discriminated in step 103 that the key input in step 102 is the choice (2), the process advances from step 103 to step 105. Then, in step 105, the CPU 21 puts itself into a waiting state for the place of or location choice (2), and if the place is inputted, then the process advances to step 111.

Then, after the process advances to step 111 whichever one of the choices (1) and (2) has been selected, the CPU 21 puts itself into a waiting state for a next key inputting operation in step 111. This key input waiting state is provided for the user to select a displaying method, and it continues until one of two following choices (A) and (B) is designated:

(A) To display a route from the present position to the destination.

For example, a map is displayed, and from among various roads to the destination, those roads which provide an optimum route are indicated by painting up them with green.

(B) To display congestion situations of roads, traffic control information and so forth.

For example, a map is displayed, and from among roads around the present place, a congested road or roads are indicated by painting up them with red. The CPU 21 thus waits for a key inputting operation to select one of the choices (A) and (B).

If a key inputting operation to designate one of the two choices (A) and (B) is performed, then the process advances to step 112, in which the key input in step 111 is discriminated. If it is discriminated that the choice (A) has been selected, then the process advances from step 112 to step 113. Then, in step 113, the CPU 21 waits for an inputting operation for the present position (or start position) and the destination necessary for display of the choice (A), and if they are inputted, then the control sequence advances to step 114, in which the setting routine 100 is ended.

On the other hand, if it is discriminated in step 112 that the key input in step 111 is the choice (B), the process skips step 113 and advances directly to step 114, in which the setting routine 100 is ended.

In this manner, the choice (1) or (2) and the choice (A) or (B) are set in the setting routine 100 in advance. It is to be noted that, upon such setting, those data which must be stored are written into and stored in the memory 24.

On the other hand, when the automobile is running or in use, of the data of the maps stored on the CD-ROM 50, those corresponding to the present position are read out in accordance with output signals of the GPS unit 12, the gyroscope 13 and the vehicle speed sensor 14, and a map including the present position is displayed on the color LCD 17 in accordance with the read out data. Further, on the map, the present position and the advancing direction of the automobile and so forth are displayed in accordance with the output signals of the GPS unit 12, the gyroscope 13 and the vehicle speed sensor 14.

Then, while such processing and displaying as described above are performed, the access routine 200 is executed by an interrupt, for example, for each one second, and the display of an image is corrected or worked for the result of setting of the setting routine 100.

In particular, in the access routine 200, the process of the CPU 21 starts from step 201, and in next step 202, it is discriminated whether or not the present point of time or the present place corresponds to the point of time of the choice (1) set in step 104 or the place or location of the choice (2) set in step 105.

Then, if the present point of time or the present place does not correspond to the point of time of the choice (1) or the place of the choice (2), then the process advances from step 202 to step 215, in which the access routine 200 is ended. Accordingly, when the present point of time or the present place does not correspond to the point of time of the choice (1) or the place of the choice (2), nothing is executed. Consequently, the display of the color LCD 17 is similar to a display of an ordinary navigation apparatus.

However, when the present point of time or the present place corresponds to the point of time of the choice (1) or the place of the choice (2) in step 202, the process advances from step 202 to step 211, in which a call to the ATIS is originated from the portable telephone set 80 and the microcomputer 20 is connected to the ATIS through the modem 18 and the portable telephone set 80.

After the microcomputer 20 is connected to the ATIS, the process advances to step 212, in which a request for data of traffic information is developed based on the data stored in the memory 24, that is, the data inputted in the setting routine 100. As a result, the object data of traffic information are transmitted from the ATIS to the navigation apparatus. After reception of the data transmitted thereto is completed, the process advances to step 213, in which ring-off processing of the portable telephone set 80 is performed.

Then, after the portable telephone set 80 is disconnected as a result of the ring-off processing, the process advances to step 214, in which the display of the color LCD 17 is corrected or worked based on the data of traffic information received in step 212 in accordance with the condition of the choice (A) or (b) set in the setting routine 100. Then, in step 215, the access routine 200 is ended.

Accordingly, with the access routine 200, when the time or the place of the condition set in the setting routine 100 is reached, latest navigation information is displayed on the color LCD 17.

In this manner, with the navigation apparatus described above, information can be obtained from the ATIS. In this instance, since data necessary to obtain object traffic information can be inputted before the automobile is used, for example, when the automobile starts, the necessary traffic information is available already, and a navigation display can be obtained in a latest traffic situation. Further, traffic information in midway of a route to a destination can be obtained automatically, and a navigation display can still be performed in a latest traffic situation.

Further, since cumbersome key operations need not be performed during running of the automobile, the safety is assured. Further, there is no need of making a fellow passenger manually operate the navigation apparatus.

Having now fully described the invention, it will be apparent to one of ordinary skill in the art that many changes and modifications can be made thereto without departing from the spirit and scope of the invention as set forth herein.

What is claimed is:

1. A navigation apparatus with an automatic navigation data receiving operation function for receiving updated traffic information from a traffic information service, comprising:

positioning means for finding a present position;

map data retrieving means for retrieving map data from a map database;

map display means for displaying a map in accordance with said map data retrieved by said map data retrieving means;

input means for enabling a user to select one of two utilization methods of said traffic information service by entering one of a desired geographic position and a time to receive information from said traffic information service, wherein said input means is manipulated by said user for entering one of said desired geographic position and said time before one of said geographic position and said time is reached;

memory means for storing one of said desired geographic position and said time to receive information;

access means including a modem and a wireless telephone for accessing said traffic information service; and decision means for controlling said access means and said map display means, wherein said decision means automatically receives said updated traffic information from said traffic information service through said access means via said modem by having said wireless telephone call said traffic information service and said map display means displays said traffic information received by said decision means on said map when said decision means decides that one of said present position matches said desired geographic position and said time is reached.

2. The navigation apparatus as claimed in claim 1, wherein said traffic information displayed on said map is a recommended route.

3. The navigation apparatus as claimed in claim 1, wherein said traffic information displayed on said map is road congestion information of a specific locality in a vicinity of said present position.

4. The navigation apparatus as claimed in claim 2, wherein said recommended route is displayed by changing a display attribute of said recommended route on said map.

5. The navigation apparatus as claimed in claim 3, wherein said traffic information of said specific locality is displayed by changing a display attribute representing said road congestion on said map.

6. The navigation apparatus as claimed in claim 4, wherein said display attribute is a color.

7. The navigation apparatus as claimed in claim 5, wherein said display attribute is a color.

8. A navigating method for a navigation apparatus for receiving updated traffic information from a traffic information service automatically, comprising the steps of:

enabling a user to select one of two utilization methods of said traffic information service by entering one of a desired geographic position and a time to receive information from a traffic information service, wherein said user enters one of said desired geographic position and said time before one of said desired geographic position and said time is reached;

storing one of said desired geographic position and said time to receive information;

finding a present position;

retrieving map data from a map database and displaying a map in accordance with said map data; and automatically receiving said updated traffic information from said traffic information service via a modem by having a wireless telephone call said traffic information service and displaying said traffic information on said map when one of said present position matches said geographic position and said time is reached.

* * * * *